US008640361B2

(12) United States Patent
Testa et al.

(10) Patent No.: US 8,640,361 B2
(45) Date of Patent: Feb. 4, 2014

(54) SPORT FOOTWEAR

(75) Inventors: Mauro Testa, Avigliana (IT); Mauro Zamprogno, Montebelluna (IT); Roberto De Marchi, Selva Del Montello (IT)

(73) Assignee: Lotto Sport Italia S.p.A., Trevignano (Treviso) (IT)

( * ) Notice: Subject to any disclaimer, the term of this patent is extended or adjusted under 35 U.S.C. 154(b) by 414 days.

(21) Appl. No.: 12/842,667

(22) Filed: Jul. 23, 2010

(65) Prior Publication Data

US 2011/0023328 A1 Feb. 3, 2011

(30) Foreign Application Priority Data

Jul. 28, 2009 (EP) ..... 09166583

(51) Int. Cl.
*A43B 13/28* (2006.01)

(52) U.S. Cl.
USPC ..... 36/27; 36/37

(58) Field of Classification Search
USPC ..... 36/27, 28, 29, 35 R, 37
See application file for complete search history.

(56) References Cited

U.S. PATENT DOCUMENTS 1,670,747 A * 5/1928 Sestito ..... 36/28
4,187,620 A * 2/1980 Selner ..... 36/28
4,322,893 A * 4/1982 Halvorsen ..... 36/43
4,881,329 A * 11/1989 Crowley ..... 36/38
4,910,884 A * 3/1990 Lindh et al. ..... 36/28
5,337,492 A * 8/1994 Anderie et al. ..... 36/28
6,055,747 A * 5/2000 Lombardino ..... 36/37
6,562,427 B2 * 5/2003 Hung ..... 428/36.9
6,751,891 B2 * 6/2004 Lombardino ..... 36/28
7,334,351 B2 * 2/2008 Hann ..... 36/27
7,565,754 B1 * 7/2009 Acheson et al. ..... 36/28
7,779,558 B2 * 8/2010 Nishiwaki et al. ..... 36/27
7,788,824 B2 * 9/2010 Hann ..... 36/27
7,814,683 B2 * 10/2010 Lee ..... 36/28
8,387,280 B2 * 3/2013 Grote et al. ..... 36/28
2002/0038522 A1 * 4/2002 Houser et al. ..... 36/28
2003/0126760 A1 * 7/2003 LeVert et al. ..... 36/27
2005/0241184 A1 * 11/2005 LeVert et al. ..... 36/27
2008/0256827 A1 * 10/2008 Hardy et al. ..... 36/27
2008/0263894 A1 * 10/2008 Nakano ..... 36/28
2010/0126040 A1 * 5/2010 Grote et al. ..... 36/28

FOREIGN PATENT DOCUMENTS

EP 0359421 A2 3/1990

* cited by examiner

*Primary Examiner* — Marie Patterson
(74) *Attorney, Agent, or Firm* — Tutunjian & Bitetto, P.C.

(57) ABSTRACT

An item of footwear, in particular for sport, includes a sole, a double-crossbow shaped elastic structure, having an upper wall and a lower wall which define an empty space inside them. The elastic structure is placed in the sole so as to elastically react under the weight of a foot. An element extends from one of the walls and is suitable for going into abutment against the opposite wall when the crossbow structure is not compressed.

15 Claims, 4 Drawing Sheets

SPORT FOOTWEAR

TECHNICAL FIELD

The present invention refers to sports footwear, and more specifically, footwear used for running, or for playing tennis.

RELATED ART

In the footwear field, many shoes are known for sport activities in general, comprising shock absorbing devices or devices that store kinetic energy, like for example, springs or elastic materials.

The objective is to dissipate some of the energy every time the foot of the athlete touches the ground, thus avoiding shocks, or to elastically accumulate the energy and send it back in the direction of movement when the foot comes off the ground.

An example of such devices is described in EP0359421.

SUMMARY

In this document, a sports shoe is described comprising a double crossbow spring, in the area under the heel, in particular an elastic-resilient helical-shaped element.

Such an element is a single separate piece, and is inserted and integrated in a through cavity of the sole. The elastic response of the element is given by the material which forms it, and by its geometric shape.

However, these two degrees of freedom may not be sufficient to fully modulate the elastic behavior of the element and therefore of the sole.

If the aforementioned element is made in a material and/or shape which yields too much, it is difficult to avoid it yielding entirely when it bears a heavy load. If the element is made in a more stiff material and/or shape, the response of the sole can be insufficient thus tiring the user and/or exposing him/her to risks of possible trauma whilst reducing the efficiency of movement and reducing the stability of the sole on the ground.

One purpose of the invention is to improve the prior art.

Another purpose of the invention is to obtain footwear which has an improved elastic response with respect to the prior art.

A further purpose of the invention is to obtain a further degree of freedom on which to act to modulate the elastic response of the footwear.

Yet another purpose of the invention is to simplify the manufacture of footwear made in this way.

Yet another purpose is to obtain a valid compromise between the protection of the athlete and his/her performance ensuring him/her that the elastic response of the controlled elasticity shock absorbing system is in the direction of its movement and that the energy collected by the system itself is exploited for such an effect.

Such purposes are obtained by footwear for practicing sport comprising a sole having a double-crossbow shaped elastic structure, having an upper wall and a lower wall which define an empty space inside them. The elastic structure is placed in the sole so as to elastically react under the weight of the foot, such that it comprises an inner element which extends from one of the walls and which is adapted for going into abutment against the opposite wall when the crossbow structure is compressed.

Said inner element acts to give controlled shock absorption.

The inclination of the same inner element with respect to the sole allows energy to be given back in the walking/running direction.

Said inner element acts as an element for controlling the inclination of the foot on the front plane avoiding hyperpronation or, for example in tennis, hyper inclination of the tibiotarsal (supination).

The shape of the crossbow structure, preferably elliptical or similar, is preferably obtained by using high resilient materials which have good elastic capability. By modifying the thicknesses of the structure at its walls, its mechanical characteristics can be modified to suit the sport technology that it will be applied to.

The inner controlling element can be inserted in the heel area and also in the area of the fifth metatarsal, extending the effect of the invention.

BRIEF DESCRIPTION OF THE DRAWINGS

Further characteristics and advantages of the invention shall become clearer from the description given as an example of footwear, together with the attached drawings in which.

DETAILED DESCRIPTION OF PREFERRED EMBODIMENTS

Figure 1:
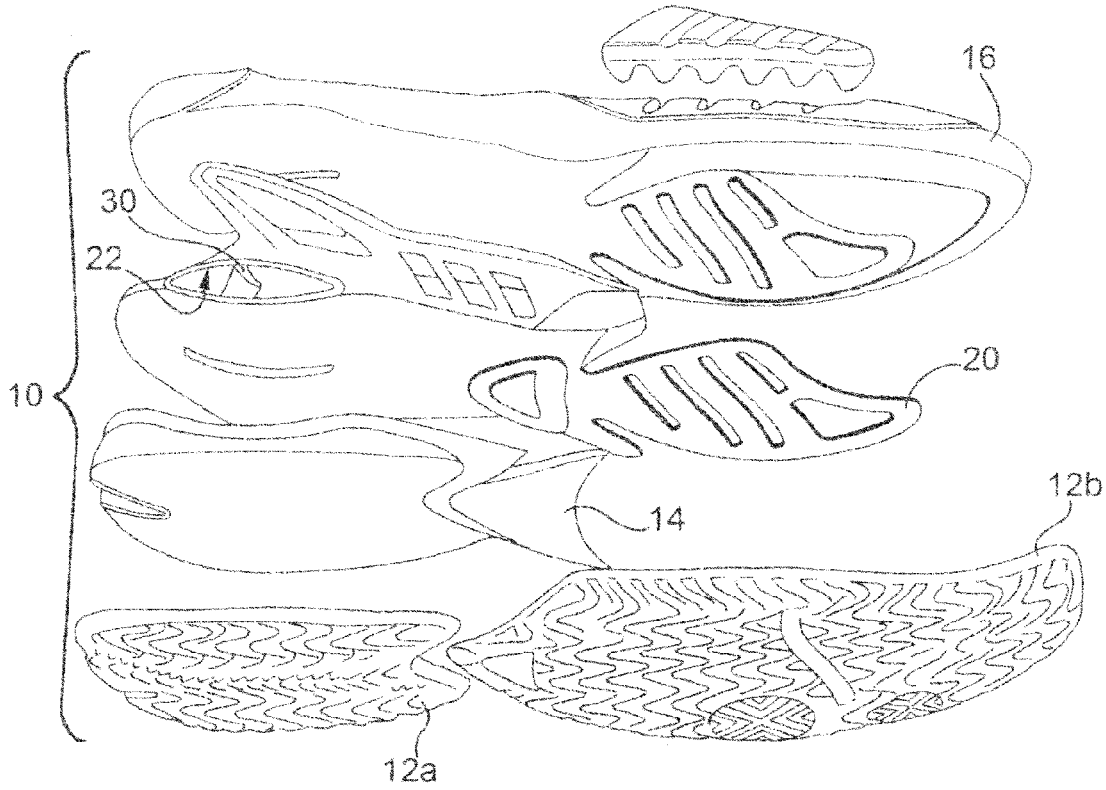
FIG. 1 shows an exploded view of the sole of footwear according to the invention.
Figure 2:
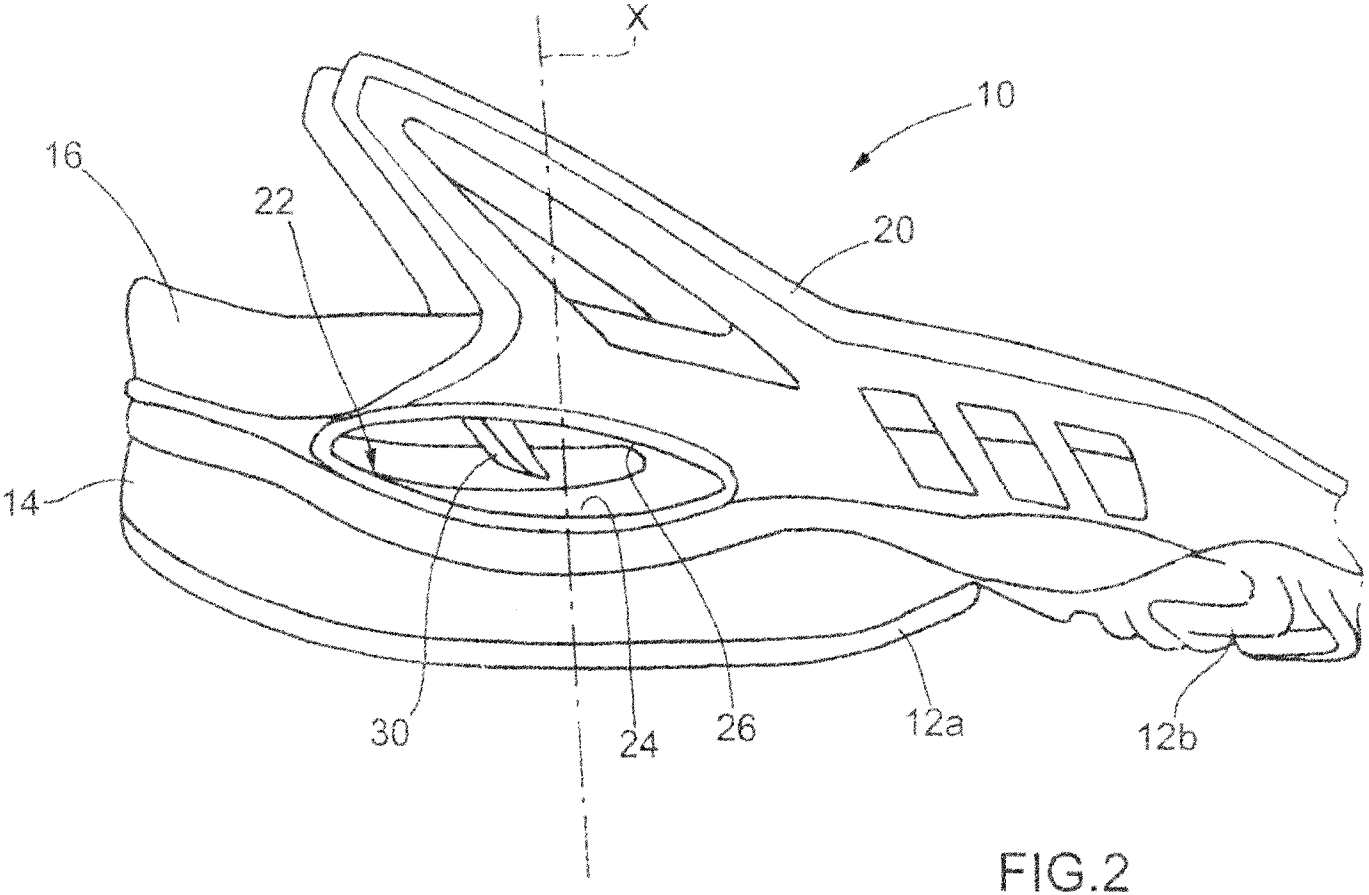
FIG. 2 shows the sole of FIG. 1 assembled.

Footwear according to the invention comprises a sole 10 formed, in sequence, by two parts of tread 12*a*, 12*b* made in rubber or thermoplastic, a heel insert 14, a first midsole element 20 and a second midsole element 16.

The first midsole element 20 is enclosed between the second midsole element 16 and the heel insert 14, and is formed in a single piece of plastic material. In the portion, which once assembled, is located under the heel of the user, the first midsole element 20 has a double crossbow-shaped elastic structure 22, with a substantially oval section, which forms a through-opening in the sole 10.

The structure 22 has an upper convex wall 26 and a lower convex wall 24, which face one another.

From the surface of the wall 26, a fin or tooth 30 extends out cantilevered, inclined with respect to an axis X that is almost vertical, which substantially corresponds to the axis along which the structure 22 deforms when it is compressed. In such a situation, the walls 24, 26 come closer together and the structure 22 reacts to the external force with an elastic reaction in the opposite direction After a certain compression of the structure 22, the fin 30 touches the opposite wall 24 and slows down or opposes further compression of the structure 20.

It should be understood that the selective intervention of the fin 30 in the compression phase of the structure 20 alters its elastic response on the foot, in particular avoiding excessive yielding and by providing a faster elastic return.

The position of the fin 30 can vary according to the desired dynamic response. Several fins can be used, arranged in same, opposite, and/or symmetric or antisymmetric manner with respect to the walls 24, 26 or to the axis X. Each combination will provide its own special dynamic response.

It should be noticed that the solution of the invention has the versatility of adapting to different usage requirements by being able to be applied to sports even involving different athletic movements. The invention does not have the mere purpose of absorbing the impact and the energy it produces, but to give it back in the direction of movement thus optimizing the use of the footwear.

The difference in thickness of the walls or their asymmetric shape enable total elasto-mechanic control of the crossbow structure.

Figure 3:
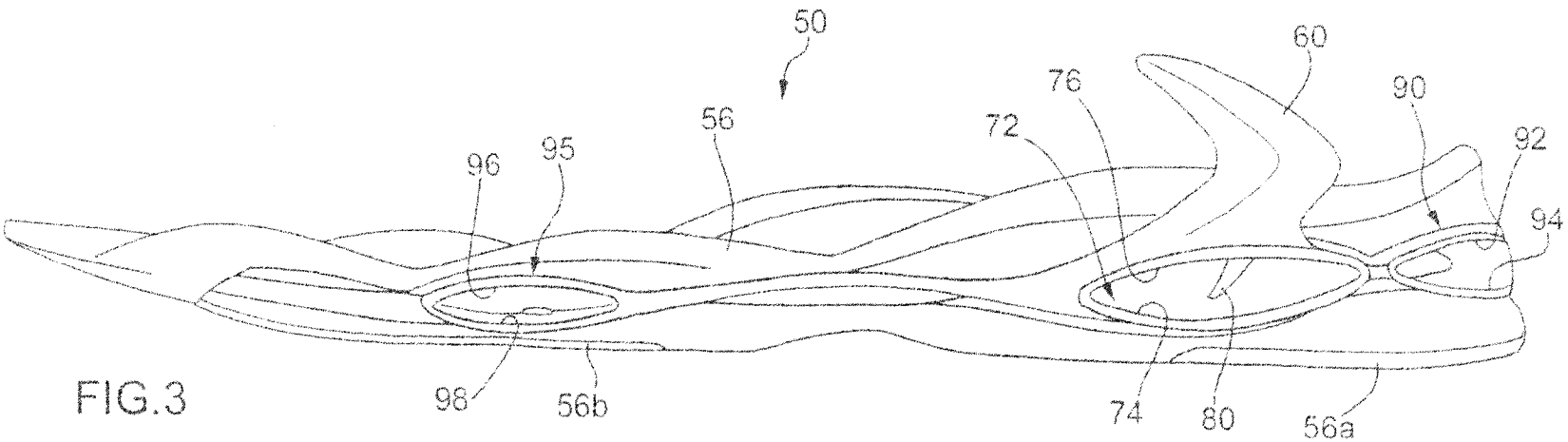
FIG. 3 shows a side view of a variant of the sole of footwear according to the invention.
Figure 4:
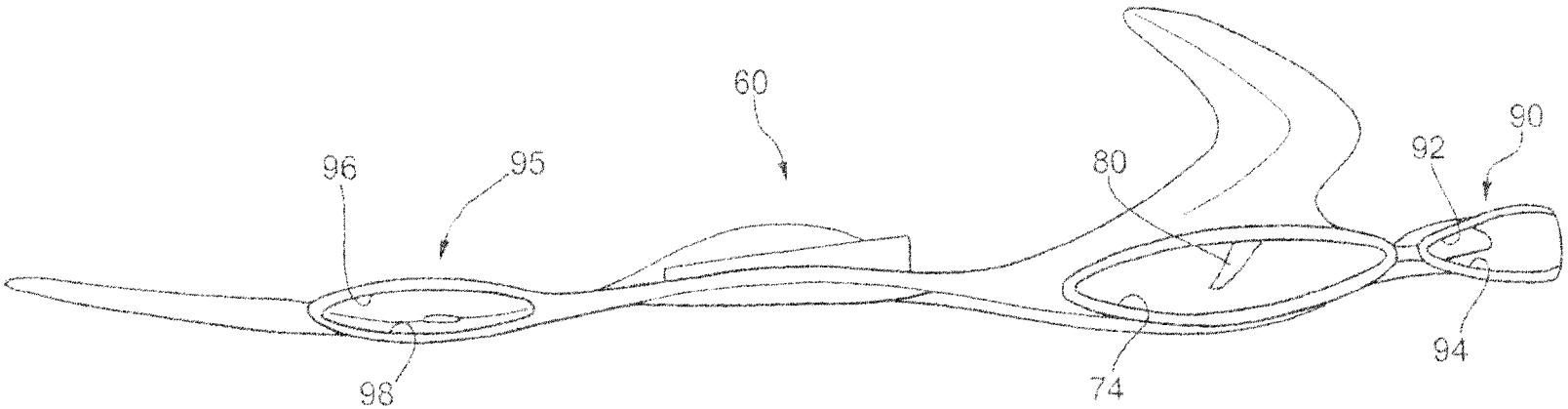
FIG. 4 shows a component of the sole of FIG. 3.
Figure 5:
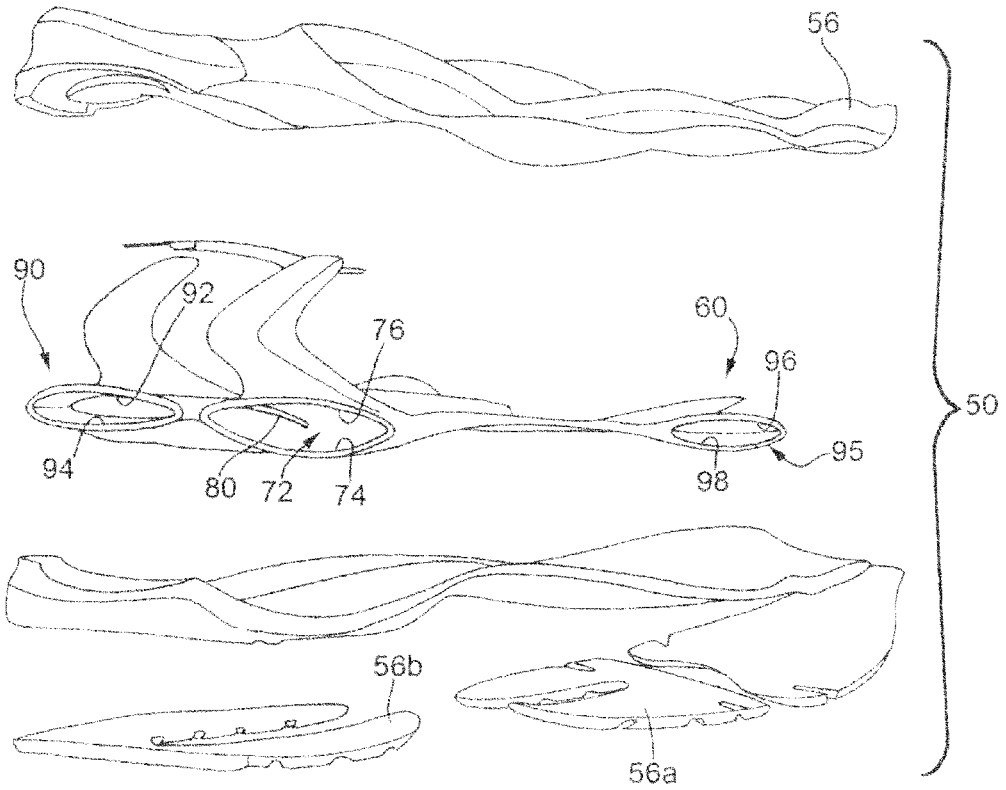
FIG. 5 shows an exploded view of the sole of FIG. 3.

FIG. 3 shows a sole variant 50, which comprises two tread parts 56*a*, 56*b* in rubber or in thermoplastic, a first midsole element 54, a second midsole element 60 and a third midsole element 56.

The second midsole element 60 is enclosed between the first and third element, and it is formed in a single piece of plastic material. Similar to the previous variant, in the portion which once assembled is located under the heel of the user; the second midsole element 60 has a double crossbow-shaped elastic structure 72, which is the same as the structure 22. The structure 72 therefore has an upper convex wall 76, a lower convex wall 74, which face each other, and a fin or tooth 80, positioned like the fin 30 and having an identical function.

The midsole element 60, unlike the element 20, has another two crossbow-shaped structures indicated with 90, 95.

The first structure 90 is arranged alongside the structure 72, roughly under the area 10 corresponding to the back of the heel, and is formed by an upper convex wall 92 and a lower convex wall 94, which face one another. The walls 92, 94 are not parallel and define a cylindroid-shaped opening with an oval base which becomes narrower towards the inside of the element 60 extending inside it for a certain depth.

The second structure 95 is arranged outside the foot, roughly under the metatarsal 15 area, and is formed by an upper convex wall 96 and a lower convex wall 98, which face one another. The walls 96, 98 are not parallel and define a cylindroid-shaped opening with an oval base which narrows towards the inside of the element 60 extending inside it for a certain depth.

Therefore, while the structure 72 passes through the sole 50 from one side to the 20 other, the structures 90, 95 only involve the edge thereof.

The function of the structures 90, 95 is to modulate and/or improve the response of the sole 50 to stress. The structure 90 ensures an elastic return action when there is an impact or pressure at the heel of the user, whereas the structure 95 ensures said action when there is an impact or pressure on the metatarsal area outside the foot.

The structures 90, 95 can be present together, or singularly, according to the desired dynamic response of the sole 50.

Other structures similar to 90, 95 can be distributed along the perimeter of the sole, in the parts which undergo most stress in the particular sports activity.

In general, the dynamic response of a sole according to the invention can be changed by varying many parameters, including:

the thickness and/or the length and/or the width and/or the position and/or the inclination of the fin 30, 50;

the material the fin 30, 50 is made with, which affects the overall elastic behavior of the structure 22. The material can be different from that which forms the midsole element 20, 60, and the fin 20 in this case is coupled with the walls of the crossbow structure with suitable fixing means, like for example, adhesive, rivets or also through over-injection;

the material the structures 22, 72, 90, 95 are made with, which affects their overall elastic behavior. The material can be different from that which forms the midsole element 20, 60, for example, by over-injecting lamellar elements to form the upper and lower walls of the crossbow structure;

the width and/or the position and/or the opening size and/or the opening shape of the structures 22, 72, 90, 95. For example, the walls of the structure can be divergent so as to form an opening in the sole with its width increasing outwards, or with a substantially constant section.

The present invention thus conceived can undergo numerous modifications and variants all covered by the scope of protection of the claims.

The invention claimed is:

1. Footwear for practicing sport comprising:

a sole comprised of a first material, said sole having an elliptical elastic structure comprising an upper and a lower wall which define an empty space inside them, the elliptical elastic structure being placed in the sole so as to elastically react under weight of a foot; and an inner elongate element comprised of a second material which is different from the first material which extends from one of said walls at an angle between 0° and 90° and which is adapted for going into abutment against the opposite wall when the elliptical structure is compressed.

2. Footwear according to claim 1, wherein the size of said elongate element is such that an empty space is formed between its free end and the opposite wall.

3. Footwear according to claim 1, wherein said elongate element is inclined with respect to a direction along which the elastic structure deforms when it is compressed.

4. Footwear according to claim 1, wherein said elongate element is formed in a single piece with the wall from which it extends.

5. Footwear according to claim 1, wherein the sole comprises another elliptical elastic structures having an upper wall and a lower wall which define an empty space inside them.

6. Footwear according to claim 5, wherein the other elliptical elastic structure is placed in the area at a back of a heel.

7. Footwear according to claim 5, wherein the other elliptical elastic structure is placed in a metatarsal area of the foot.

8. Footwear according to claim 5, wherein the lower and upper walls of the other elliptical elastic structure extend inside the sole for a depth such as to not pass through it from one side to the other.

9. Footwear according to claim 1, wherein one or each of the walls of the elliptical elastic structure is convex.

10. Footwear according to claim 1, wherein the elliptical elastic structure is formed in a single piece in a midsole element.

11. Footwear according to claim 1, wherein the walls of the elliptical elastic structure are divergent so as to form an opening in the sole with a width which increases towards the outside of the sole.

12. Footwear according to claim 1, wherein the empty space defined by the walls of the elliptical elastic structure communicates with the space outside of the sole.

13. Footwear according to claim 1, wherein the wails of the elliptical elastic structure are asymmetric with respect to one another.

14. Footwear according to claim 1, wherein the walls of the elliptical elastic structure have different thicknesses.

15. Footwear for practicing sport comprising:

a sole comprised of a first material, said sole having an elliptical elastic structure comprising an upper and a lower wall which define an empty space inside them, the elastic structure being placed in the sole so as to elastically react under weight of a foot; and an inner elongate element comprised of a second material which is different from the first material which extends from one of said walls at an angle between 0° and 90° and which is adapted for going into abutment against the opposite wall when the elliptical structure is compressed, wherein the upper and lower walls of the elliptical elastic structure have different thicknesses.

* * * * *